US011021955B2

(12) United States Patent
Mulvoy et al.

(10) Patent No.: US 11,021,955 B2
(45) Date of Patent: Jun. 1, 2021

(54) TUNNEL SUPPORT SYSTEM AND METHOD

(71) Applicant: DSI TUNNELING LLC, Louisville, KY (US)

(72) Inventors: John M. Mulvoy, Louisville, KY (US); Andrew J. King, Georgetown, IN (US)

(73) Assignee: DSI TUNNELING LLC, Louisville, KY (US)

( * ) Notice: Subject to any disclaimer, the term of this patent is extended or adjusted under 35 U.S.C. 154(b) by 0 days.

(21) Appl. No.: 16/742,524

(22) Filed: Jan. 14, 2020

(65) Prior Publication Data

US 2020/0263543 A1 Aug. 20, 2020

Related U.S. Application Data

(60) Provisional application No. 62/807,796, filed on Feb. 20, 2019.

(51) Int. Cl.
*E21D 11/10* (2006.01)
*E21D 11/38* (2006.01)
*E21D 11/08* (2006.01)

(52) U.S. Cl.
CPC ..... *E21D 11/107* (2013.01); *E21D 11/08* (2013.01); *E21D 11/385* (2013.01)

(58) Field of Classification Search
CPC ..... E04B 1/3533; E04B 1/32; E21D 11/107; E21D 11/08; E21D 11/383; E21D 11/385
See application file for complete search history.

(56) References Cited

U.S. PATENT DOCUMENTS 1,112,542 A 10/1914 Loser
1,174,931 A 3/1916 Furry
(Continued)

FOREIGN PATENT DOCUMENTS

CN 108343449 A 7/2018
DE 3432259 * 3/1983
(Continued)

OTHER PUBLICATIONS

International Preliminary Examination Report on Patentability dated Dec. 21, 2020 from corresponding International Patent Application No. PCT/US2020/013516, 119 pages.
(Continued)

*Primary Examiner* — Carib A Oquendo
(74) *Attorney, Agent, or Firm* — Ohlandt, Greeley, Ruggiero & Perle, L.L.P.

(57) ABSTRACT

A tunnel reinforcement system having a plurality of structural supports positioned at spaced intervals along the length of a tunnel. Each structural support has a plurality of structural segments connected in an end to end relationship. Each structural segment has a plurality of bars connected to a first end and a second end, in which the first end comprises a first butt plate having one or more apertures, and the second end comprises a second butt plate having one or more apertures. The one or more apertures of the first butt plate or the second butt plate of a structural segment are coaxially aligned with the one or more apertures of the first butt plate or the second butt plate of another structural segment in an end to end relationship. The first butt plate or the second butt plate of a structural segment is attachable to the first butt plate or the second butt plate of another structural segment in an end to end relationship. Each structural support defines a geometric supporting framework.

35 Claims, 11 Drawing Sheets

(56) References Cited

U.S. PATENT DOCUMENTS

| | | | | |
|---|---|---|---|---|
| 1,353,274 | A * | 9/1920 | Schlueter | E21D 11/08 405/152 |
| 2,793,720 | A | 5/1957 | Hawes | |
| 3,057,119 | A | 10/1962 | Kessler | |
| 3,783,573 | A | 1/1974 | Vaughan | |
| 3,849,953 | A | 11/1974 | Cohen | |
| 4,007,507 | A | 2/1977 | Hansen | |
| 4,335,556 | A * | 6/1982 | Arnold | E04C 3/08 52/650.2 |
| 4,373,305 | A | 2/1983 | Russell | |
| 4,593,710 | A | 6/1986 | Stafford et al. | |
| 4,619,099 | A | 10/1986 | Sircovich | |
| 5,103,523 | A | 4/1992 | Drago et al. | |
| 5,159,790 | A | 11/1992 | Harding | |
| 6,129,484 | A | 10/2000 | Chiaves | |
| 9,200,462 | B2 | 12/2015 | Valente et al. | |
| 2009/0090070 | A1* | 4/2009 | Finch | E04B 1/3205 52/94 |
| 2012/0152437 | A1 | 6/2012 | Cisneros | |
| 2017/0362812 | A1 | 12/2017 | Garry | |

FOREIGN PATENT DOCUMENTS

| | | | |
|---|---|---|---|
| DE | 3432259 | A1 | 3/1986 |
| KR | 20140094398 | * | 7/2014 |
| KR | 20140094398 | A | 7/2014 |
| KR | 10-1881889 | B1 | 7/2018 |
| KR | 101881889 | * | 7/2018 |
| WO | 90/12167 | A1 | 10/1990 |
| WO | 92/03622 | A1 | 3/1992 |
| WO | 01/51769 | A1 | 7/2001 |

OTHER PUBLICATIONS

International Search Report dated Apr. 8, 2020 from corresponding International Patent Application No. PCT/US2020/013516, 3 pages.

Written Opinion dated Apr. 8, 2020 from corresponding International Patent Application No. PCT/US2020/013516, 7 pages.

* cited by examiner

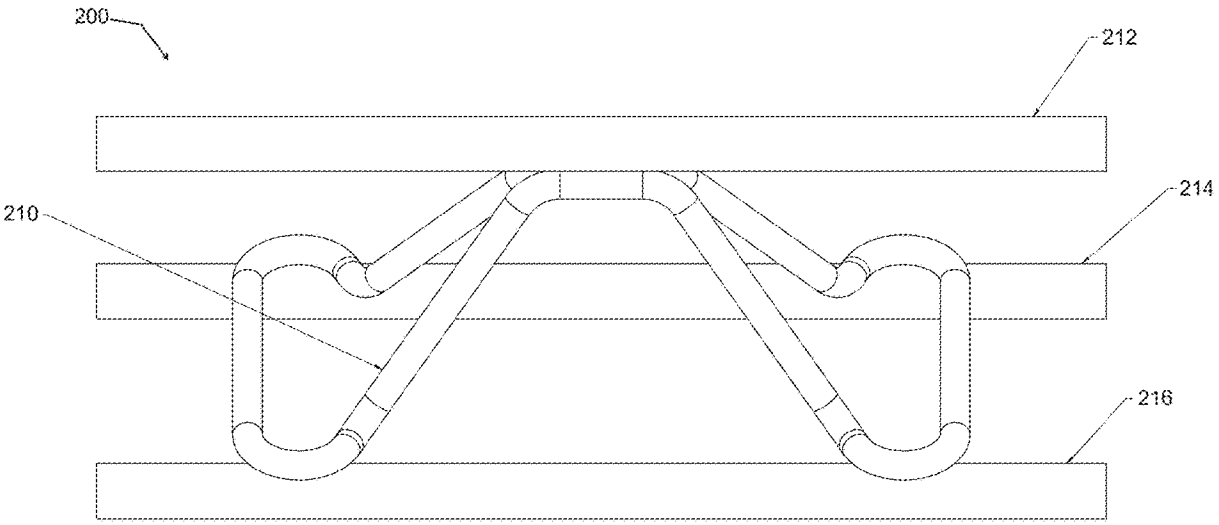
FIG. 2A
Fig. 2B
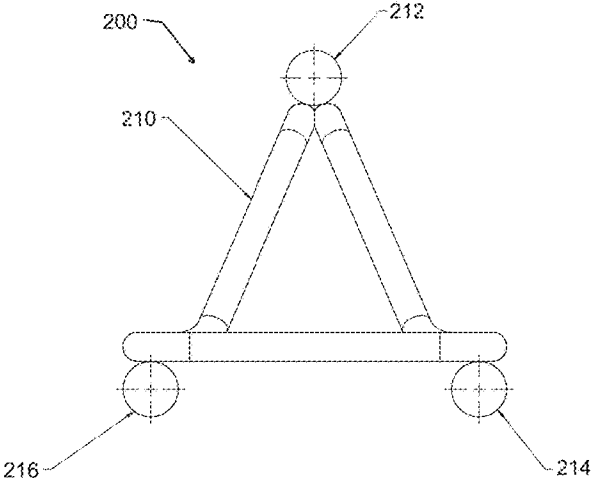

TUNNEL SUPPORT SYSTEM AND METHOD

CROSS-REFERENCED APPLICATIONS

This application claims priority to U.S. Provisional Application No. 62/807,796, filed on Feb. 20, 2019, which is incorporated herein in its' entirety by reference thereto.

BACKGROUND

1. Field of the Disclosure

This disclosure relates to a tunnel support system, and a method of supporting a tunnel. The tunnel support system is useful, for example, in underground tunneling, excavating and mining operations.

2. Discussion of the Background Art

Underground tunneling roof and sidewall control is important for the safety and wellbeing of workers and users of the finished tunneling operation. Surface control is critical to effective underground tunneling roof and sidewall support systems. Surface control devices with adequate characteristics can help reduce or even eliminate progressive underground tunneling roof and sidewall failures.

Roof and sidewall supports are commonly used in underground tunneling, excavating, and mining operations to support and control the overhead and lateral rock and soil strata. In one conventional tunneling surface control system, hand tied rebar is used which requires massive amounts of manpower literally tying each and every corner of bar intersection with wire ties. The labor and time intensive rebar exerts a compressive force upon the mine roof and sidewall to prevent deterioration of the overhead and lateral rock and soil strata.

Due to the labor intensity required for conventional rebar installation in underground tunneling, excavating and mining operations, it would be desirable to develop a tunnel support system that provides improved installation efficiencies, improved quality control structural connections, and resultant job site safety.

The present disclosure provides many advantages, which shall become apparent as described below.

SUMMARY

This disclosure relates to a tunnel support system, and a method of supporting a tunnel. The tunnel support system is useful, for example, in underground tunneling, excavating and mining operations.

This disclosure also relates to a tunnel support system having an initial tunnel reinforcement system, in which the initial tunnel reinforcement system is overlayed or encapsulated with concrete or a cement material; a final tunnel reinforcement system, in which the final tunnel reinforcement system is overlayed or encapsulated with concrete or a cement material; and a moisture barrier system, in which the moisture barrier system is positioned between the initial tunnel reinforcement system overlayed or encapsulated with concrete or a cement material, and the final tunnel reinforcement system overlayed or encapsulated with concrete or a cement material. The initial tunnel reinforcement system and the final tunnel reinforcement system comprise: a plurality of structural supports positioned at spaced intervals along the length of a tunnel. Each structural support comprises a plurality of structural segments connected in an end to end relationship. Each structural segment comprises a plurality of bars connected to a first end and a second end, in which the first end comprises a first butt plate having one or more apertures, and the second end comprises a second butt plate having one or more apertures. The one or more apertures of the first butt plate or the second butt plate of a structural segment are coaxially aligned with the one or more apertures of the first butt plate or the second butt plate of another structural segment in an end to end relationship. The first butt plate or the second butt plate of a structural segment is attachable to the first butt plate or the second butt plate of another structural segment in an end to end relationship. Each structural support defines a geometric supporting framework (e.g., arch).

This disclosure further relates in part to a method of supporting a tunnel. The method comprises: positioning a tunnel support system against a tunnel substrate; and maintaining the tunnel support system in contact with the tunnel substrate. The tunnel support system comprises: an initial tunnel reinforcement system, in which the initial tunnel reinforcement system is overlayed or encapsulated with concrete or a cement material; a final tunnel reinforcement system, in which the final tunnel reinforcement system is overlayed or encapsulated with concrete or a cement material; and a moisture barrier system, in which the moisture barrier system is positioned between the initial tunnel reinforcement system overlayed or encapsulated with concrete or a cement material, and the final tunnel reinforcement system overlayed or encapsulated with concrete or a cement material. The initial tunnel reinforcement system and the final tunnel reinforcement system comprise: a plurality of structural supports positioned at spaced intervals along the length of a tunnel. Each structural support comprises a plurality of structural segments connected in an end to end relationship. Each structural segment comprises a plurality of bars connected to a first end and a second end. The first end comprises a first butt plate having one or more apertures, and the second end comprises a second butt plate having one or more apertures. The one or more apertures of the first butt plate or the second butt plate of a structural segment are coaxially aligned with the one or more apertures of the first butt plate or the second butt plate of another structural segment in an end to end relationship. The first butt plate or the second butt plate of a structural segment is attachable to the first butt plate or the second butt plate of another structural segment in an end to end relationship. Each structural support defines a geometric supporting framework (e.g., arch).

This disclosure yet further relates in part to a tunnel reinforcement system comprising: a plurality of structural supports positioned at spaced intervals along the length of a tunnel. Each structural support comprises a plurality of structural segments connected in an end to end relationship. Each structural segment comprises a plurality of bars connected to a first end and a second end. The first end comprises a first butt plate having one or more apertures, and the second end comprises a second butt plate having one or more apertures. The one or more apertures of the first butt plate or the second butt plate of a structural segment are coaxially aligned with the one or more apertures of the first butt plate or the second butt plate of another structural segment in an end to end relationship. The first butt plate or the second butt plate of a structural segment is attachable to the first butt plate or the second butt plate of another structural segment in an end to end relationship. Each structural support defines a geometric supporting framework (e.g., arch).

An advantage of this disclosure is the ability of the tunnel support system to provide improved installation efficiencies, improved quality control structural connections, and resultant job site safety. The tunnel reinforcement system of this disclosure replaces conventional tunneling surface control systems, such as labor and time intensive hand tied rebar. In contrast to labor and time intensive hand tied rebar, the tunnel reinforcement system of this disclosure can be prefabricated off site. This allows welding of bar placement and intersections instead of tied, and provides repetitive and improved quality and durability during placement on site. The tunnel support system of this disclosure provides compression for holding in place the underground tunnel roof and sidewall material, and thereby prevents collapse of the tunnel.

Further objects, features and advantages of the present disclosure will be understood by reference to the following drawings and detailed description.

BRIEF DESCRIPTION OF THE DRAWINGS

FIG. 2A shows a section of a three (3) bar spider structural segment in accordance with an embodiment of this disclosure. FIG. 2B shows general dimensions of a cross section of a three (3) bar spider structural segment in accordance with an embodiment of this disclosure.

DETAILED DESCRIPTION OF THE EMBODIMENTS

Figure 1:
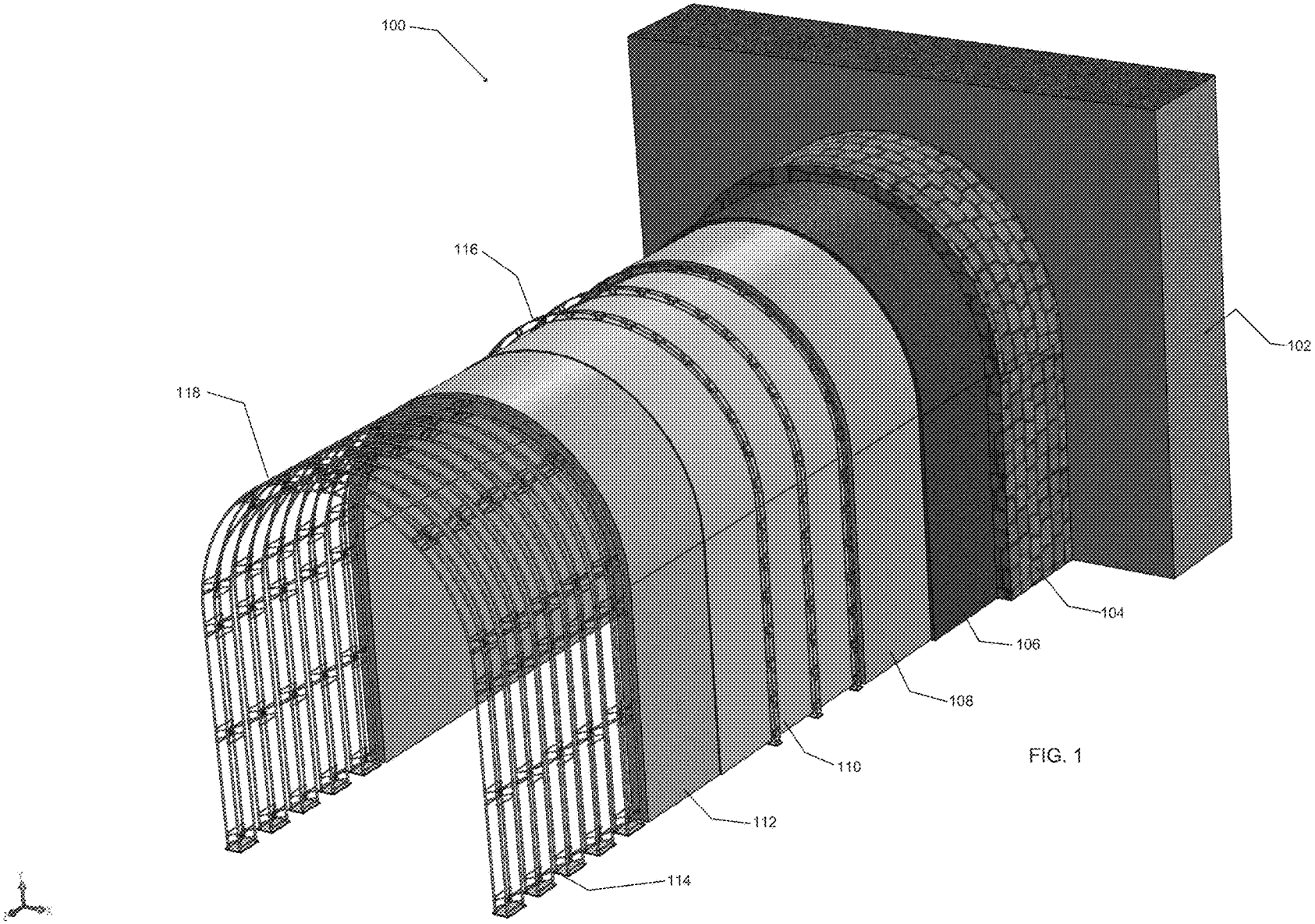
FIG. 1 shows a partially exploded view of a tunnel support system of this disclosure.

This disclosure provides a prefabricated reinforcement system for final tunnel linings. In comparison with conventional rebar support systems, the tunnel reinforcement systems of this disclosure offer higher quality shop fabrication, reduced installation time (e.g., less manhours), lower costs, topside panel completion, increased safety including less manpower in harms way during installation, significant erection safety with lower hinged connections, and tilt up versus complicated lifts.

Prefabricated reinforcement steel is preferably used in the tunnels support system of this disclosure. The tunnel reinforcement system of this disclosure builds upon the spatial arrangement of spiders to optimize bar placement and sectional girder properties within existing concrete design. The tunnel reinforcement system of this disclosure provides equivalent area of steel (As) in comparison to conventional rebar reinforcement systems. The tunnel reinforcement system of this disclosure can employ higher strength steel to modestly increase bar spacing for enhanced concrete placement (larger spaces). The tunnel reinforcement system of this disclosure significantly improves installation cycle times. The tunnel reinforcement system of this disclosure affords zero variance in bar placement (i.e., lattice girders are precise and longitudinal bar placements are fixed with hooks). The tunnel reinforcement system of this disclosure provides lower overall installation cost and improved safety in comparison with conventional labor and time intensive rebar systems.

Multiple bar structural segments are useful in the tunnel reinforcement system of this disclosure. The structural segments preferably have from about three (3) to about twelve (12) bars connected to the first end and the second end of the structural segment. Particularly, multiple bar spider structural segments can include, for example, spider configurations having 3, 4, 5, 6, 7, 8, 9, 10, 11, 12, or greater bars. The bar configuration and number of bars is limited only by application space and contractor capabilities.

Butt plates useful in this disclosure afford significant advantages over hand tied bar reinforcement systems. Typical hand tied bar reinforcement systems employ lap lengths to provide bar continuity beyond the nominal bar length. For example, a bar reinforced matt might be 400 feet long. To achieve the 400 feet of length, multiple bars are tied together. To do so requires an overlap of the bars to create the continuity of a single bar. The lap length is a function of the bar size and design requirements. These lap lengths are typically 3 to 15 linear feet each so to assemble 400 linear feet of bar there may be as much as 150 feet of lapped bar. As part of the tunnel reinforcement system of this disclosure, lap length is eliminated by the butt plate connection. The bars are terminated at the butt plate and fastened in an equivalent design by butt plate design inclusive of weldments and other structural elements, providing equivalency to any comparative lap length.

For larger tunnel reinforcement systems of this disclosure, a knuckle component can be used in conjunction with the butt plate. This knuckle component simplifies the most complicated area of conventional bar reinforcement (i.e., intersections). Intersections require the connection of bars at transverse or skewed angles depending upon the project geometry. The knuckle component provides for the lap bar splicing noted above, and the directional and geometric accommodation necessary, all in one single unit. The butt plate ends are designed and located so that all forces are transferred appropriately into and through the intersections. The knuckle component assemblies are efficiently installed. The size is only limited by a contractors means and methods or other physical limitations.

To accommodate the geometric differences, the knuckle component utilizes structural side plates creating a full moment connection, which thereby replaces the intersecting and overlapped hand tied bar reinforcement. The intersection is also a self-supporting structure that requires little supplementary support once connected end to end. Additionally, most underground caverns, tunnels and stations require a water proofing membrane to eliminate water intrusion or exit. Use of conventional tied bar reinforcement typically requires the installation of expensive and time consuming bolts to support the reinforcement bar mat while put into place. Use of the tunnel reinforcement system of this disclosure totally eliminates the bolts which thereby eliminates the bolt penetration through the membrane. The cost of installation and subsequent repairs is very costly. The tunnel reinforcement system of this disclosure solves this problem.

A partially exploded view of a tunnel support system of this disclosure is shown in FIG. 1. The tunnel support system 100 is positioned against a tunnel substrate 104, which is underground 102. The substrate can be, for example, rock, soil or an existing structure. The tunnel support system 100 includes an initial tunnel reinforcement system 108, which is overlayed or encapsulated with concrete or a cement material 106. The tunnel support system 100 also includes a final tunnel reinforcement system 114, which is overlayed or encapsulated with concrete or a cement material 112. The tunnel support system 100 further includes a moisture barrier system 110. The moisture barrier system 110 is positioned between the initial tunnel reinforcement system 108 overlayed or encapsulated with concrete or a cement material 106, and the final tunnel reinforcement system 114 overlayed or encapsulated with concrete or a cement material 112. The initial tunnel reinforcement system 108 and the final tunnel reinforcement system 114 include a plurality of structural supports 116 and 118, respectively, positioned at spaced intervals along the length of the tunnel. Each structural support 116 and 118 defines a geometric supporting framework (e.g., arch).

Typically, the initial tunnel reinforcement system 108 has fewer structural supports 116 positioned at spaced intervals along the length of a tunnel, than the number of structural supports 118 positioned at spaced intervals along the length of a tunnel in the final tunnel reinforcement system 114. The initial support structure 108 is typically a template lattice girder of some depth and spacing to allow the spray application of concrete or a cement material 106 which adheres to tunnel walls and ceilings. In the initial tunnel reinforcement system 108, the lattice girders 116 function as a concrete depth gage and provide a minimal structural element of support to the initial shell. In the final tunnel reinforcement system 114, the lattice girders 118 function as a concrete depth gage and provide a more maximal structural element of support to the final shell. The tunnel reinforcement system of this disclosure is far more dense in terms of steel and design as part of the initial and/or final shell in comparison to a conventional rebar system.

In an embodiment, a perspective view of a section of a three (3) bar spider structural segment 100 is shown in FIG. 2A. The three (3) bar spider structural segment 200 includes three (3) radial bars (212, 214 and 216) spaced apart by a spider 210. Structural capacity of radial bars in a tunnel or cavern can be optimized by the use of three (3) bar spider structural segments 200. General dimensions of a cross section of a three (3) bar spider structural segment are shown in FIG. 2B.

Figure 3A:
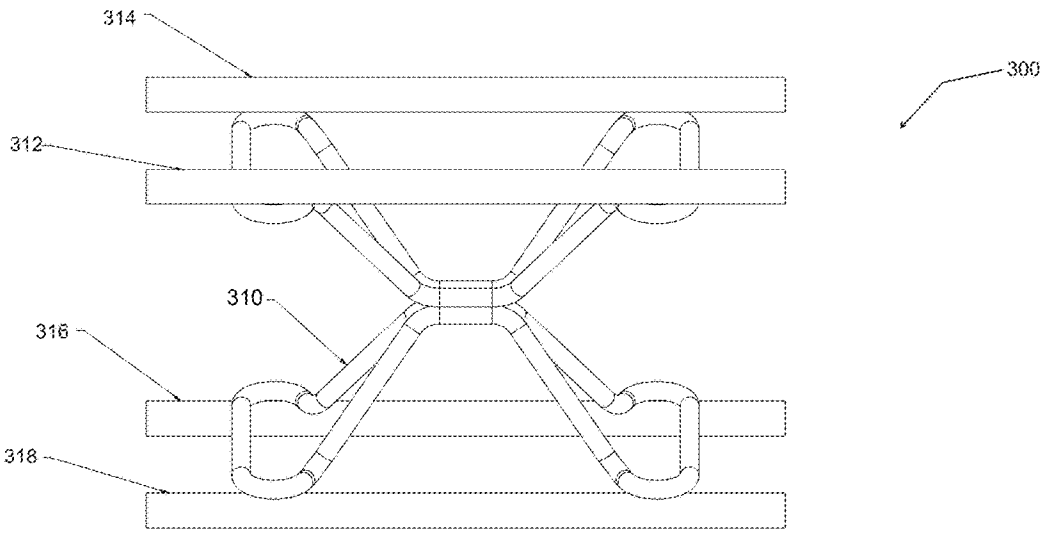
FIG. 3A shows a section of a four (4) bar spider structural segment in accordance with an embodiment of this disclosure.
Figure 3B:
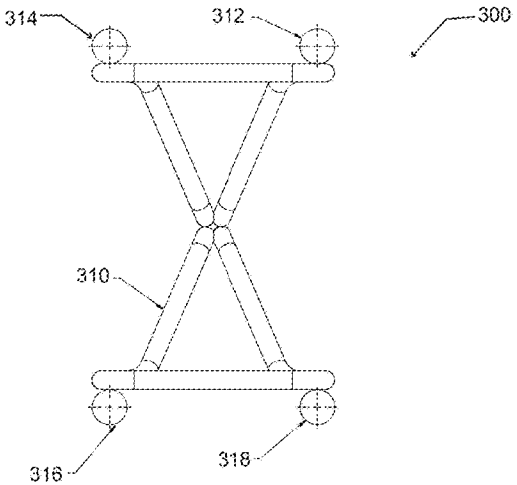
FIG. 3B shows general dimensions of a cross section of a four (4) bar spider structural segment in accordance with an embodiment of this disclosure.

In another embodiment, a perspective view of a section of a four (4) bar spider structural segment 300 is shown in FIG. 3A. The four (4) bar spider structural segment 300 includes four (4) radial bars (312, 314, 316 and 318) spaced apart by a spider 310. Structural capacity of radial bars in a tunnel or cavern can be optimized by the use of four (4) bar spider structural segments 300. General dimensions of a cross section of a four (4) bar spider structural segment are shown in FIG. 3B.

The structural capacity of radial bars in a tunnel or cavern can be optimized by the use of both three (3) bar spider structural segments 200 and four (4) bar spider structural segments 300, however generally the four (4) bar system exceeds the capacity of the three (3) bar system. The use of either a four (4) bar system or a three (3) bar system in a tunnel reinforcement system of this disclosure is dependent on the thickness of the initial or final concrete shell.

Figure 4:
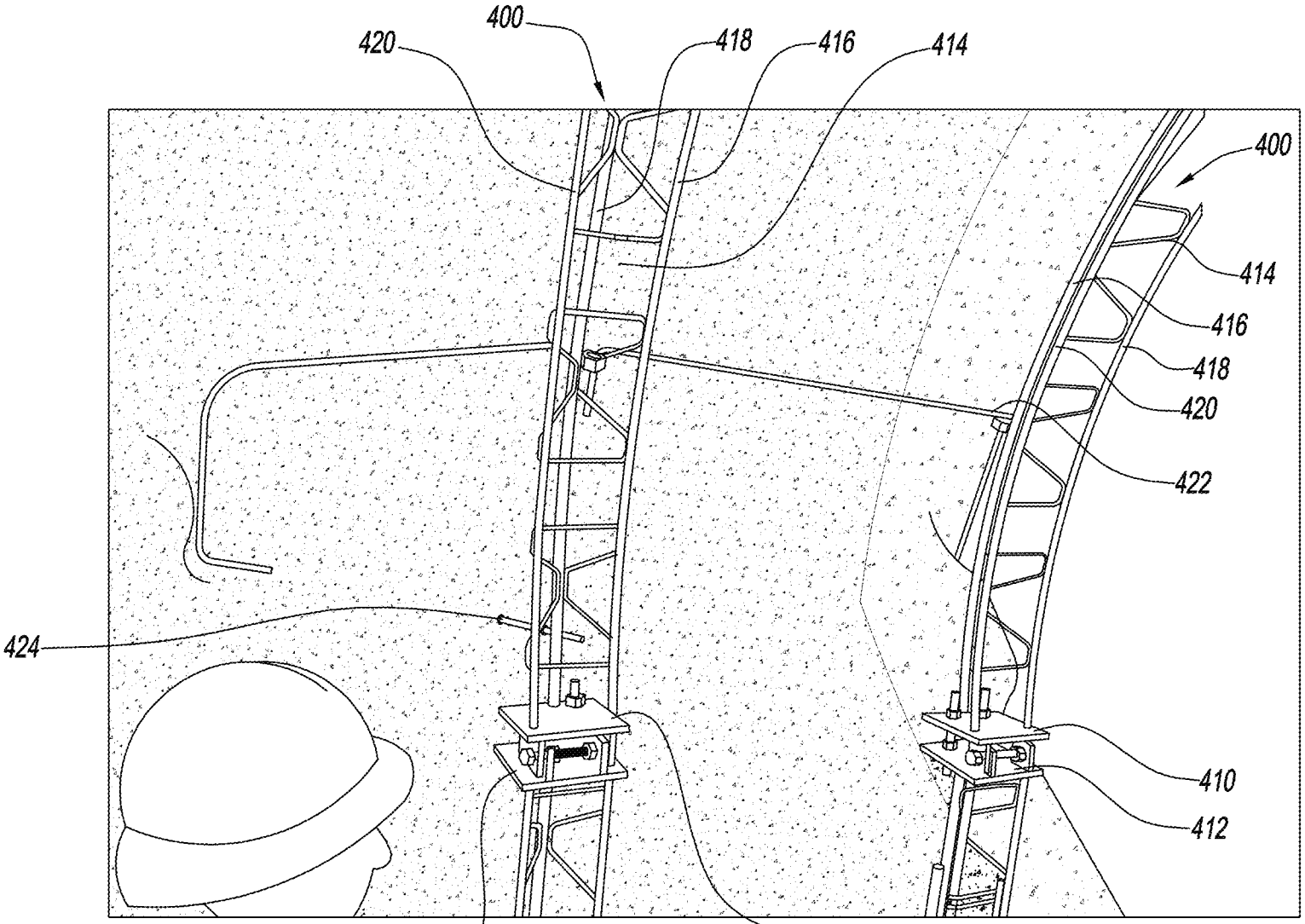
FIG. 4 shows sections of three (3) bar spider structural segments having connected butt plates in accordance with an embodiment of this disclosure.

Sections of three (3) bar spider structural segments having connected butt plates are shown in FIG. 4. The structural segments 400 are configured in an end to end relationship forming structural supports (i.e., lattice girders) that define a geometric supporting framework (i.e., arch). The three (3) bar spider structural segments 400 include three (3) radial bars (416, 418 and 420) spaced apart by spiders 414. Butt plates 410 and 412 are positioned at the ends of the of three (3) bar spider structural segments 400. The three (3) bar spider structural segments 400 are attachable by the butt plates 410 and 412. As shown in FIG. 4, the butt plates 410 and 412 are attachable with bolts and nuts. Other conventional methods may be used for attaching the butt plates 410 and 412.

The structural supports formed from the structural segments 400 in an end to end relationship are positioned at spaced intervals along the length of a tunnel. One or more stabilizing members 422 can be connected to adjacent structural supports. Illustrative stabilizing members 422 include, for example, tie rods and the like. In addition, one or more stabilizing members 424 can be connected to structural supports for use in stabilizing the structural supports against the surface of the tunnel or cavern. Illustrative stabilizing members 424 include, for example, rods, hooks, and the like.

In an embodiment, the butt plates 410 are hingedly attachable to butt plates 412 of adjacent structural segments 400 in an end to end relationship. In such an embodiment, one or more hinges pivotally connect the structural segments 400 in an end to end relationship. Hinges are an optional connection embodiment in the tunnel reinforcement system of this disclosure. The hinges are designed as a structurally competent components sufficient to meet the requirements of regular reinforcement bar mat lap splicing and butt joint design replacement.

Figure 5B:
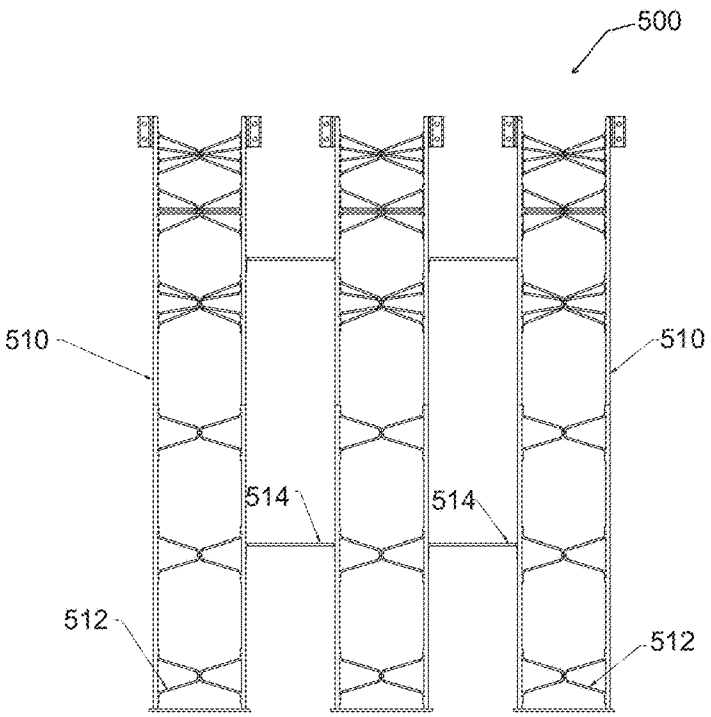
FIG. 5B is a side view of a lattice girders in accordance with an embodiment of this disclosure.
Figure 5A:
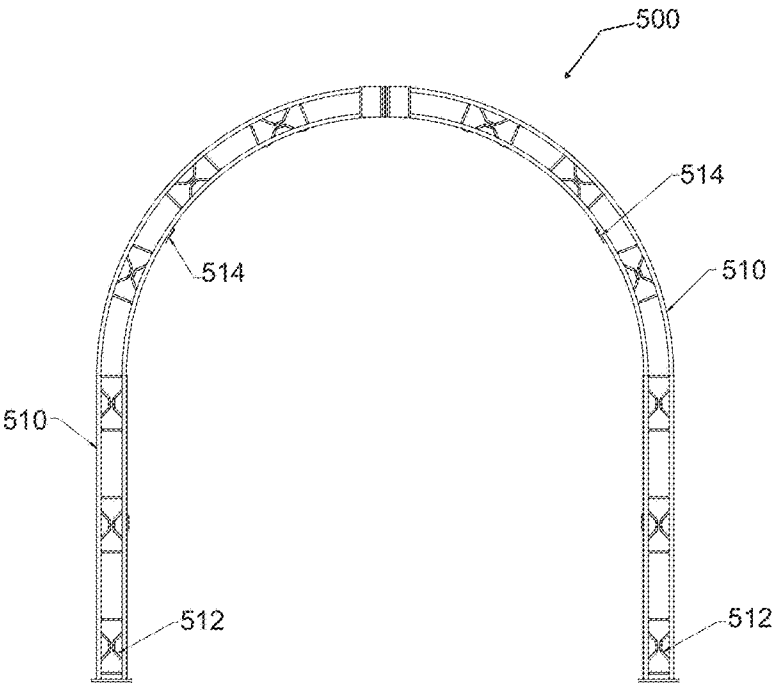
FIG. 5A is an elevation view of a lattice girder in accordance with an embodiment of this disclosure.

An elevation view of a lattice girder 500 used in the tunnel reinforcement system of this disclosure is shown in FIG. 5A. Multiple bar spider structural segments 510 connected in an end to end relationship form the lattice girder 500 shown in FIG. 5A. The multiple bar spider structural segments 510 includes multiple radial bars spaced apart by spiders 514. Foot plates 512 with embedded rebar are shown at both bases of the lattice girder 500. The lattice girder 500 defines a geometric supporting framework (i.e., arch).

A side view of lattice girders 500 used in the tunnel reinforcement system of this disclosure is shown in FIG. 5B. Multiple bar spider structural segments 510 connected in an end to end relationship form the lattice girders 500 shown in FIG. 5B. The multiple bar spider structural segments 510 includes multiple radial bars spaced apart by spiders 512. One or more stabilizing members 514 can be connected to adjacent lattice girders. Illustrative stabilizing members 514 include, for example, tie rods and the like.

Figure 6B:
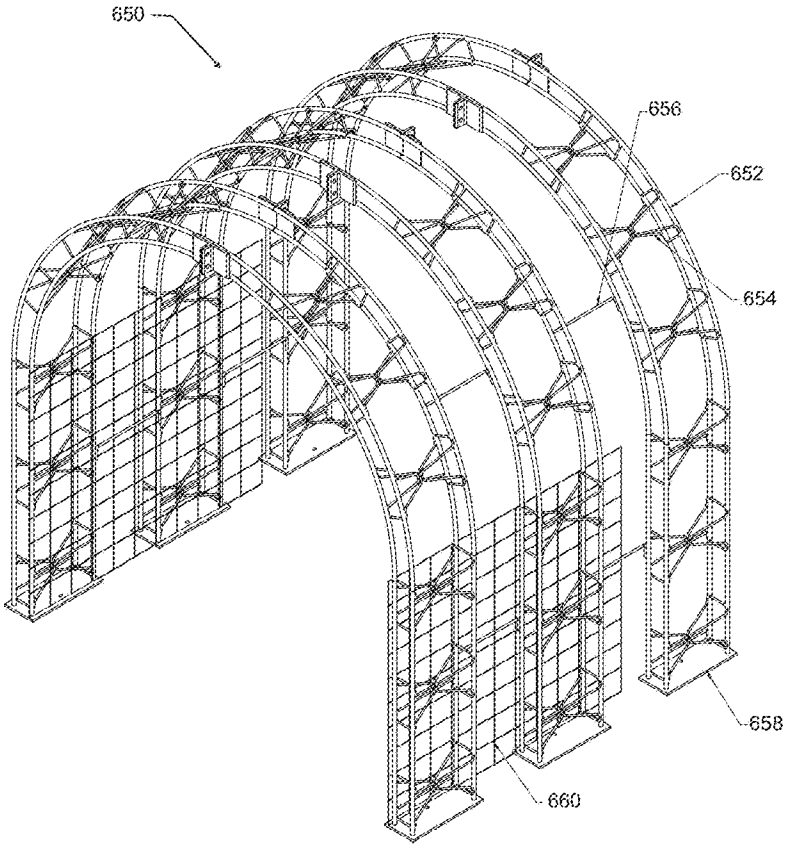
FIG. 6B shows lattice girders in a tunnel reinforcement system in accordance with an embodiment of this disclosure.
Figure 6A:
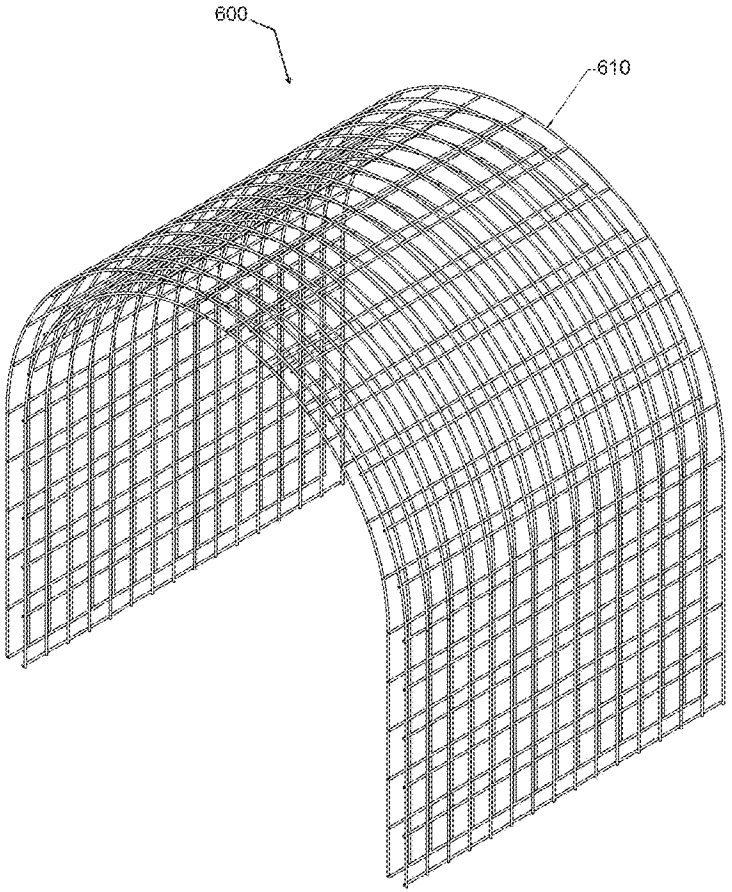
FIG. 6A (Prior Art)
FIG. 6A shows a conventional rebar support system.

A conventional rebar support system 600 is shown in FIG. 6A. Hand tied rebar 610 is used which requires large amounts of manpower literally tying each and every corner of bar intersection with wire ties. The labor and time intensive rebar exerts a compressive force upon the mine roof and sidewall to prevent deterioration of the overhead and lateral rock or soil strata.

Lattice girders 650 in a tunnel reinforcement system in accordance with this disclosure are shown in FIG. 6B. Four (4) bar spider structural segments 652 connected in an end to end relationship form the lattice girders 650 shown in FIG. 6B. The four (4) bar spider structural segments 652 includes four (4) radial bars spaced apart by spiders 654. One or more stabilizing members 656 can be connected to adjacent lattice girders. Illustrative stabilizing members 656 include, for example, tie rods and the like. Foot plates 658 with embedded rebar are shown at bases of the lattice girders 650. Mesh 660 is shown interconnecting with the plurality of structural supports (i.e., lattice girders). The lattice girders 650 each define a geometric supporting framework (i.e., arch).

The geometric shape of the tunnel reinforcement system of this disclosure can be adaptable to any substrate geometry. In particular, the tunnel reinforcement system of this disclosure can be a universal geometric shape (e.g., ellipsoid, trapezoid, square, circle, and the like). The substrate can include, for example, rock, soil, or an existing structure.

Wire mesh and/or other intrados or extrados bars (longitudinal to the tunnel axis) may be added for concrete shrinkage or cracking control. The tunnel reinforcement system of this disclosure includes customized hooks to attach mesh to the tunnel reinforcement system. This also supports the original rebar design intent and function. In an embodiment, wire mesh is applied over some or all of the tunnel reinforcement system to facilitate adherence of the cementitious sealing composition.

In an embodiment, rebar can be used to interconnect with the structural supports. In another embodiment, mesh 660 can be used to interconnect with the structural supports. A combination of rebar and mesh 660 can also be used. In addition, mesh 660 can be replaced with fiber reinforced shotcrete.

In a comparison of material required for a conventional rebar system versus a tunnel reinforcement system of this disclosure, for a tunnel of comparative length and support, the total material required for the tunnel reinforcement system of this disclosure is significantly reduced, as a result of group installation, as compared to the total material required for the conventional rebar system.

Figure 7:
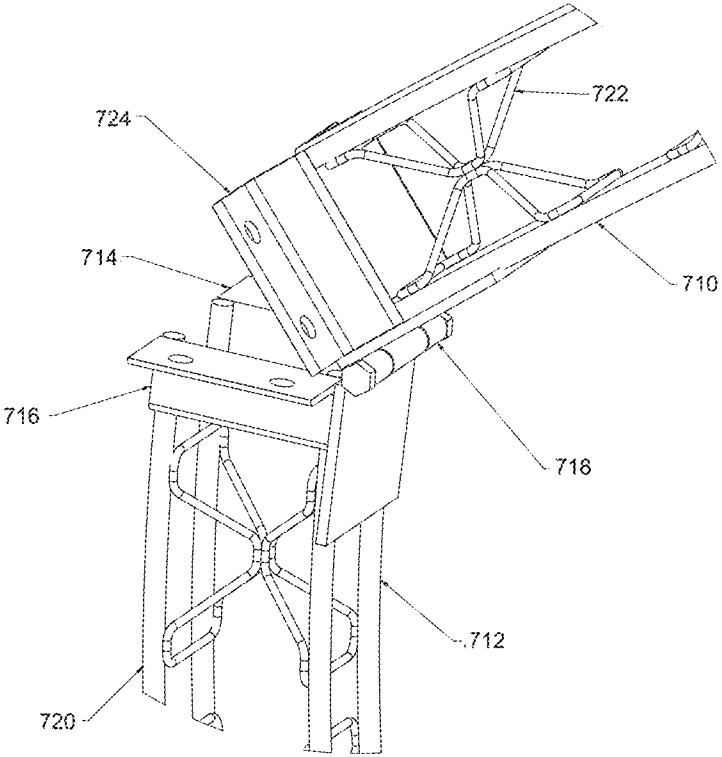
FIG. 7 shows sections of four (4) bar spider structural segments having hinged connected butt plates in accordance with an embodiment of this disclosure.

Sections of four (4) bar spider structural segments 710 and 712 having hinged (open) connected butt plates are shown in FIG. 7. In an embodiment, the butt plate 714 is hingedly attached to butt plate 716 of adjacent structural segments 710 and 712 in an end to end relationship. The hinge 718 pivotally connects the structural segments 710 and 712 in an end to end relationship. The four (4) bar spider structural segments 710 and 712 include four (4) radial bars spaced apart by spiders 720 and 722. The through-holes or apertures (724 on top butt plate 714) on the butt plates 714 and 716 are coaxially aligned for attaching the structural segments 710 and 712.

Figure 8:
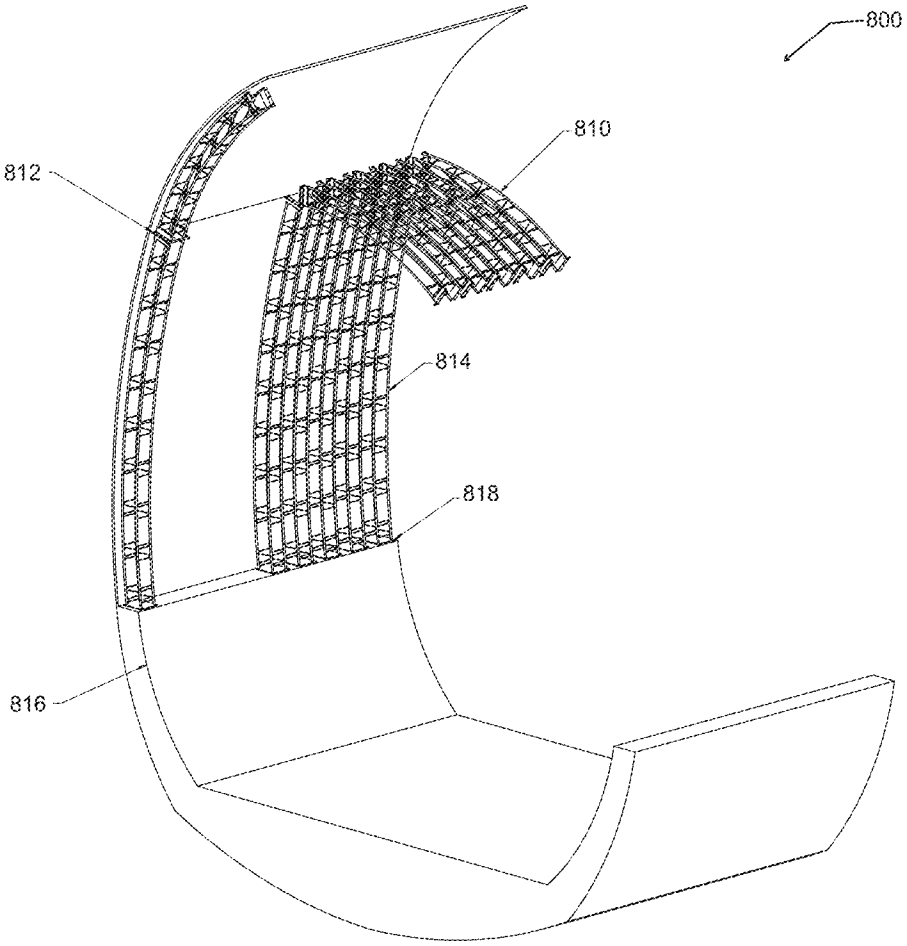
FIG. 8 is a perspective view of a tunnel reinforcement system with concrete invert in accordance with an embodiment of this disclosure.

A perspective view of a tunnel reinforcement system 800 of this disclosure with concrete invert 816 is shown in FIG. 8. A completely erected segment 810 of lattice girders of this disclosure is shown being fitted against flashcrete 812. Completed lattice girders 814 are shown installed on the flashcrete 812. The lattice girders 814 are installed on the top of the existing concrete wall 818. Hinged structural segments making up the lattice girders allow for levered or tilt-up installation of the segments as shown in FIG. 8.

In an embodiment, whole sections of the tunnel reinforcement system can be pre-assembled above ground. After assembly, the whole sections can be lowered by crane into the tunnel or cavern for installation.

The number is tie rods used in the tunnel reinforcement system of this disclosure is not critical. The tunnel reinforcement system consists of nominal or higher strength steel with increased bar spacing if acceptable or a replication of the original design in a modular form for installation reducing on site labor costs, improving efficiency and providing a safer work space.

Figure 9B:
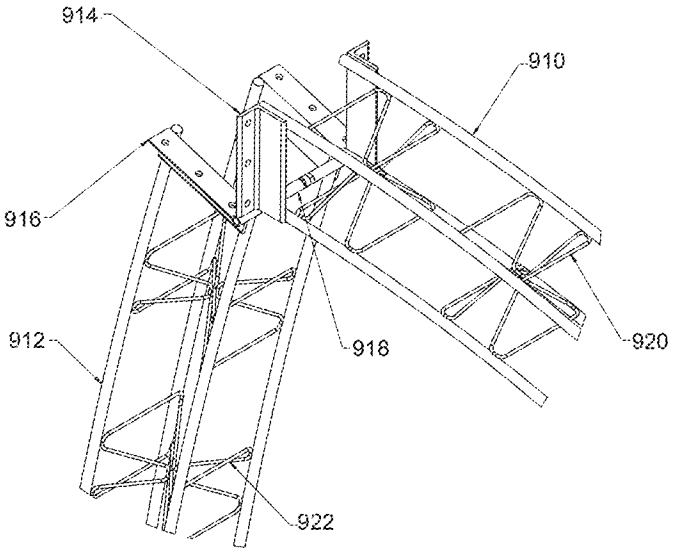
FIG. 9B shows sections of four (4) bar spider structural segments having hinged connected butt plates (open) in accordance with an embodiment of this disclosure.
Figure 9A:
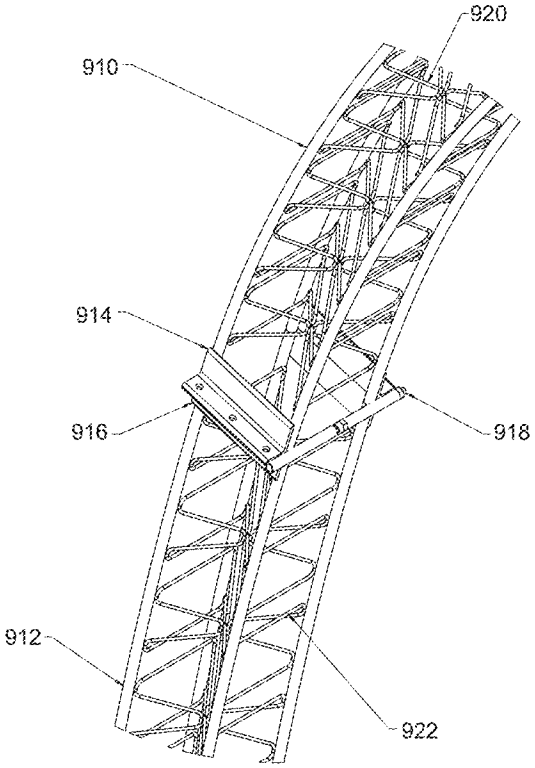
FIG. 9A shows sections of four (4) bar spider structural segments having hinged connected butt plates (closed) in accordance with an embodiment of this disclosure.

Sections of multiple bar spider structural segments 910 and 912 having hinged (closed) connected butt plates are shown in FIG. 9A. In an embodiment, the butt plate 914 is hingedly attached to butt plate 916 of adjacent structural segments 910 and 912 in an end to end relationship. The hinge 918 pivotally connects the structural segments 910 and 912 in an end to end relationship. The four (4) bar spider structural segments 910 and 912 include multiple radial bars spaced apart by spiders 920 and 922. Through-holes or apertures on the butt plates 914 and 916 are coaxially aligned for attaching the structural segments 910 and 912. Hinged structural segments making up the lattice girders allow for levered or tilt-up installation of the segments as shown in FIG. 9A.

Sections of multiple bar spider structural segments 910 and 912 having hinged (open) connected butt plates are shown in FIG. 9B. In an embodiment, the butt plate 914 is hingedly attached to butt plate 916 of adjacent structural segments 910 and 912 in an end to end relationship. The hinge 918 pivotally connects the structural segments 910 and 912 in an end to end relationship. The four (4) bar spider structural segments 910 and 912 include multiple radial bars spaced apart by spiders 920 and 922. Through-holes or apertures on the butt plates 914 and 916 are coaxially aligned for attaching the structural segments 910 and 912. Hinged structural segments making up the lattice girders allow for levered or tilt-up installation of the segments as shown in FIG. 9B.

Figure 10B:
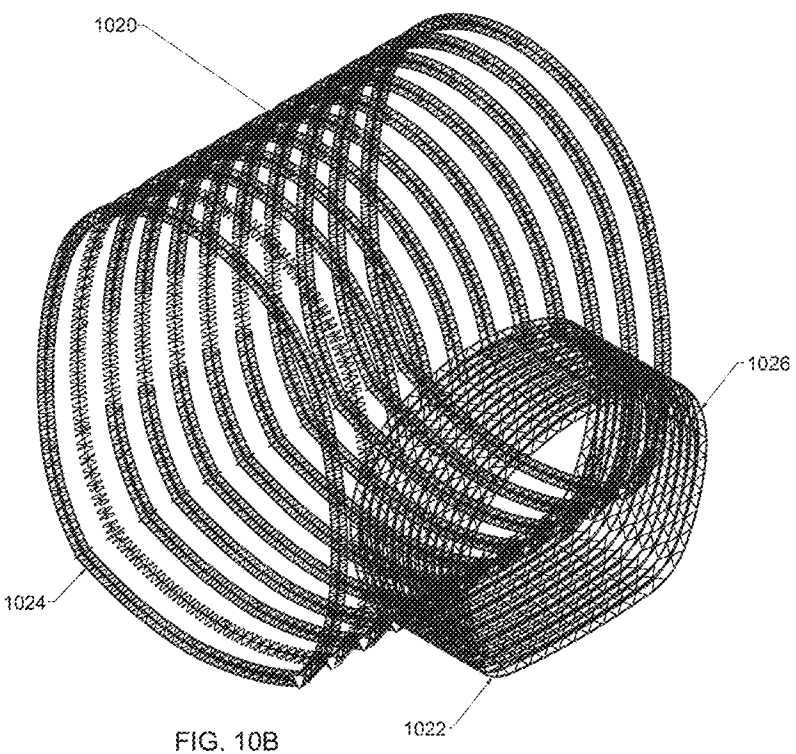
FIG. 10B shows the intersection of two (2) ellipsoidal tunnel reinforcement systems (i.e., lattice girders) in accordance with an embodiment of this disclosure.
Figure 10A:
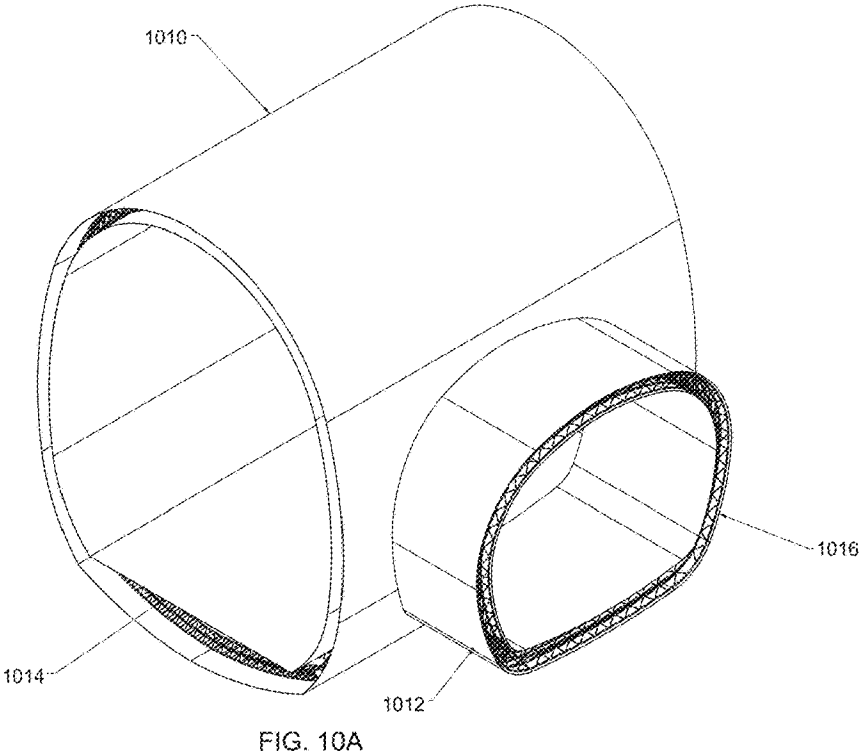
FIG. 10A shows the intersection of two (2) ellipsoidal tunnel reinforcement systems in accordance with an embodiment of this disclosure.

FIG. 10A shows tunnel reinforcement systems having intersecting geometries. In particular, the intersection of two (2) ellipsoidal tunnel reinforcement systems 1010 and 1012 is shown in FIG. 10A. Lattice girders 1014 are shown in the larger tunnel reinforcement system 1010. Lattice girders 1016 are shown in the smaller intersecting tunnel reinforcement system 1012.

FIG. 10B shows tunnel reinforcement systems having intersecting geometries. In particular, the intersection of two (2) ellipsoidal tunnel reinforcement systems 1020 and 1022 (i.e., lattice girders) is shown in FIG. 10B. Lattice girders 1024 are shown in the larger tunnel reinforcement system 1020. Lattice girders 1026 are shown in the smaller intersecting tunnel reinforcement system 1022.

For tunnel reinforcement systems having intersecting geometries, moment connections simplify the reinforcement bar mat. The moment connections are designed to transfer bending moments, shear forces and sometimes normal forces. The design strength and stiffness of a moment connection are defined in relation to the strength and stiffness of the connected tunnel reinforcement systems. The design strength of a moment connection may be full strength (i.e., the moment capacity of the connection is equal to or larger than the capacity of the connected tunnel reinforcement systems) or partial strength (i.e., the moment capacity of the connection is less than that of the connected tunnel reinforcement systems). Similarly the stiffness of a moment connection can be rigid or semi-rigid compared to the stiffness of the connected tunnel reinforcement systems.

Figure 11B:
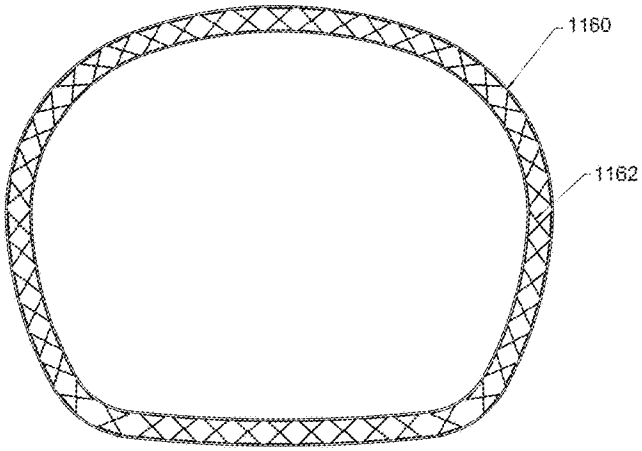
FIG. 11B shows the intersection section of the smaller ellipsoidal tunnel reinforcement system in FIGS. 10A and 10B in accordance with an embodiment of this disclosure.
Figure 11A:
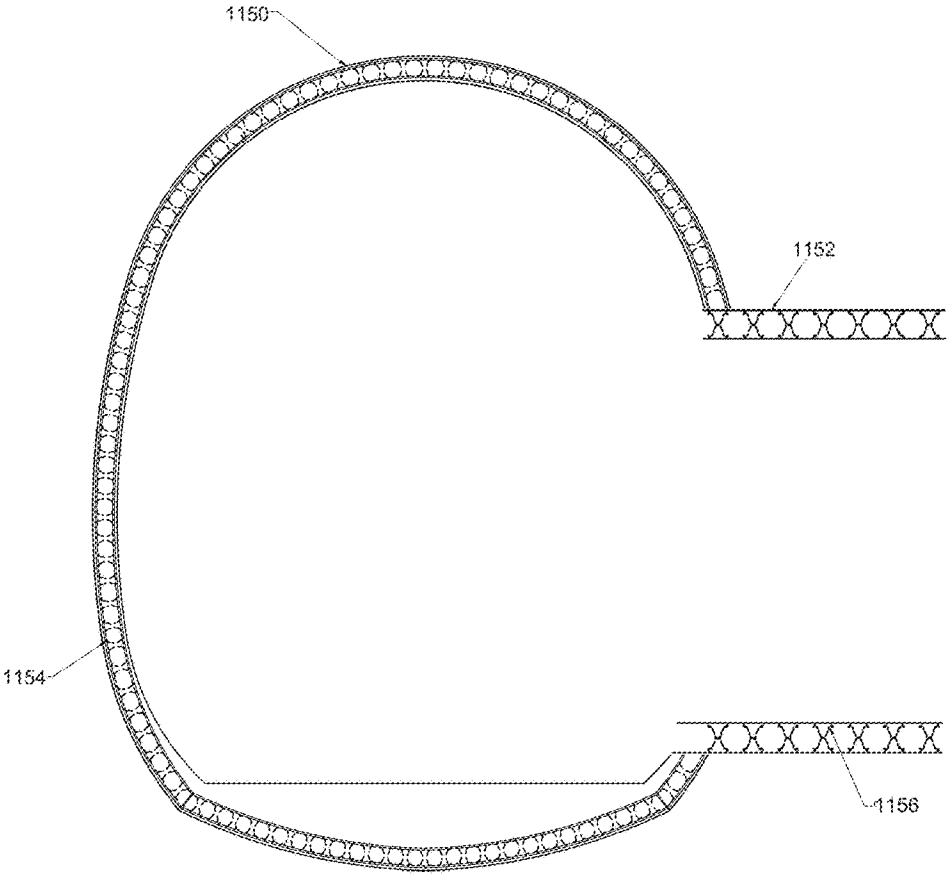
FIG. 11A shows intersection sections of two (2) ellipsoidal tunnel reinforcement systems in FIGS. 10A and 10B in accordance with an embodiment of this disclosure.

FIG. 11A shows intersection sections of two (2) ellipsoidal tunnel reinforcement systems 1150 and 1152 in FIGS. 10A and 10B in accordance with an embodiment of this disclosure. The view is looking down the larger tunnel. Lattice girders 1154 are shown in the larger tunnel reinforcement system 1150. Lattice girders 1156 are shown in the smaller intersecting tunnel reinforcement system 1152.

FIG. 11B shows the intersection section of the smaller ellipsoidal tunnel reinforcement system 1160 in FIGS. 10A and 10B in accordance with an embodiment of this disclosure. The view is looking down the small tunnel. Lattice girders 1162 are shown in the smaller intersecting tunnel reinforcement system 1160.

In accordance with this disclosure, tunnels and caverns are first created by earth or rock excavation with an immediate application of an initial support structure. The initial support structure is typically a template lattice girder of some depth and spacing to allow the spray application of zero slump shotcrete which adheres to cavern walls and ceilings. The depth of concrete is of a designed depth and the lattice girders function as a concrete depth gage and provide a minimal structural element of support to the initial shell. The tunnel reinforcement system of this disclosure is far more dense in terms of steel and design as part of the initial and/or final shell in comparison to a conventional rebar system. The tunnel reinforcement system of this disclosure is placed adjacent/inside of the initial shell and is then encapsulated to the finished wall lines by either more shotcrete or concrete pumped into forms under high pressure. This is typical. Final concrete panels of 50 feet are typical. The travelling formwork leap frogs back and forth until all the final tunnel reinforcement system and concrete is placed completing the final shell.

The tunnel reinforcement system of this disclosure is encapsulated to the finished wall lines by overlaying or encapsulating with concrete. Illustrative concrete includes, for example, shotcrete concrete, zero slump concrete, sliding form concrete, and the like. The concrete can be pumped into movable forms under pressure. The movable formwork leap frogs back and forth until all the final tunnel reinforcement system and concrete is placed, thereby completing the final shell.

In an embodiment, the tunnel reinforcement system is constructed out of prefabricated metal supports (i.e., lattice girders) that fit and interlock together to form the walls and roof of the tunnel reinforcement system. The tunnel reinforcement system is configured to fit the applicable intersection, as irregularities of the tunnel leads to varying dimensions of intersections.

The tunnel reinforcement system of this disclosure can be prefabricated off site. This allows welding of bar placement and intersections instead of tied, and provides repetitive and improved quality and durability during placement on site. The tunnel reinforcement system of this disclosure provides compression for holding in place the underground tunnel roof and sidewall material, and thereby prevents collapse of the tunnel support members useful in this disclosure may be formed by conventional methods known in the art.

Alternatively, the tunnel reinforcement system (i.e., initial and final liner) can be assembled in place in the tunnel. A cementitious sealing composition is applied to the exterior of the tunnel reinforcement system in order to provide sealing as well as strength. For example, shotcrete or gunite is applied to tunnel reinforcement system in order to not only seal the system, but also to span any gaps between the system and the sidewalls and ceiling defining the passageways in which the system is positioned. In some embodiments, wire mesh is first applied over some or all of the tunnel reinforcement system to facilitate adherence of the cementitious sealing composition.

The embodiments of the tunnel reinforcement system of this disclosure can be sufficiently flexible to compensate for variations in the angle of the roof and side walls, and/or variations due to non-planar surfaces of the roof and/or side walls.

The tunnel support system of this disclosure includes a moisture barrier system. The moisture barrier system is positioned between the initial tunnel reinforcement system that has been encapsulated with concrete or a cement material, and the final tunnel reinforcement system that has been encapsulated with concrete or a cement material. Illustrative moisture barriers include, for example, plastic materials (e.g., polyethylene plastic), sealants, foams, and the like.

The tunnel support system of this disclosure is useful in a variety of applications, for example, tunneling, excavating, mining, and the like. In an embodiment, the tunnel support system is useful for underground tunneling for transportation purposes (e.g., building underground railways or roadways). Other applications include, for example, sewerage tunnels, utility tunnels, and the like.

While we have shown and described several embodiments in accordance with our disclosure, it is to be clearly understood that the same may be susceptible to numerous changes apparent to one skilled in the art. Therefore, we do not wish to be limited to the details shown and described but intend to show all changes and modifications that come within the scope of the appended claims.

What is claimed is:

1. A tunnel support system comprising:

an initial tunnel reinforcement system; wherein the initial tunnel reinforcement system is encapsulated with concrete or a cement material;

a final tunnel reinforcement system; wherein the final tunnel reinforcement system is encapsulated with concrete or a cement material; and a moisture barrier system; wherein the moisture barrier system is positioned between the initial tunnel reinforcement system encapsulated with concrete or a cement material, and the final tunnel reinforcement system encapsulated with concrete or a cement material;

wherein the initial tunnel reinforcement system and the final tunnel reinforcement system comprise:

a plurality of structural supports positioned at spaced intervals along the length of a tunnel;

wherein each structural support comprises a plurality of structural segments connected in an end to end relationship;

wherein each structural segment comprises a plurality of bars connected to a first end and a second end; wherein the first end comprises a first butt plate having one or more apertures, and the second end comprises a second butt plate having one or more apertures;

wherein the one or more apertures of the first butt plate or the second butt plate of a structural segment are coaxially aligned with the one or more apertures of the first butt plate or the second butt plate of another structural segment in an end to end relationship;

wherein the first butt plate or the second butt plate of a structural segment is attachable to the first butt plate or the second butt plate of another structural segment in an end to end relationship; and wherein each structural support defines a geometric supporting framework.

2. The tunnel support system of claim 1 wherein the moisture barrier system comprises a plastic material, sealant, or foam.

3. The tunnel support system of claim 1 wherein the structural supports comprise lattice girders.

4. The tunnel support system of claim 1 wherein the initial tunnel reinforcement system has fewer structural supports positioned at spaced intervals along the length of a tunnel, than the final tunnel reinforcement system.

5. The tunnel support system of claim 1 wherein the geometric supporting framework comprises an ellipsoid or trapezoid.

6. The tunnel support system of claim 1 wherein the structural segments comprise from about three (3) to about twelve (12) bars connected to the first end and the second end.

7. The tunnel support system of claim 1 wherein the structural segments comprise three (3) bar spider structural segments, four (4) bar spider structural segments, eight (8) bar spider structural segments, or mixtures thereof.

8. The tunnel support system of claim 1 wherein the first butt plate or the second butt plate of a structural segment is hingedly attachable to the first butt plate or the second butt plate of another structural segment in an end to end relationship.

9. The tunnel support system of claim 8 wherein one or more hinges pivotally connect the structural segments in an end to end relationship.

10. The tunnel support system of claim 1 wherein the one or more apertures of the first butt plate or the second butt plate of a structural segment are attachable with the one or more apertures of the first butt plate or the second butt plate of another structural segment in an end to end relationship with one or more bolts and nuts.

11. The tunnel support system of claim 1 wherein the initial tunnel reinforcement system and the final tunnel reinforcement system further comprise rebar interconnecting with the plurality of structural supports.

12. The tunnel support system of claim 1 wherein the final tunnel reinforcement system further comprises mesh interconnecting with the plurality of structural supports.

13. The tunnel support system of claim 1 wherein the initial tunnel reinforcement system and the final tunnel reinforcement system further comprise one or more stabilizing members connected to individual structural supports, or one or more stabilizing members connected to adjacent structural supports.

14. The tunnel support system of claim 13 wherein the stabilizing members connected to individual structural supports comprise hooks, and the stabilizing members connected to adjacent structural supports comprise tie rods.

15. The tunnel support system of claim 1 installed in an underground tunnel for transportation or utilities.

16. The tunnel support system of claim 1 wherein at least one of the initial tunnel reinforcement system and the final tunnel reinforcement system is prefabricated and installed on site.

17. The tunnel support system of claim 1 comprising an intersection of two or more tunnel reinforcement systems.

18. A method of supporting a tunnel, said method comprising:

positioning a tunnel support system against a tunnel substrate; and maintaining the tunnel support system in contact with the tunnel substrate;

wherein the tunnel support system comprises:

an initial tunnel reinforcement system; wherein the initial tunnel reinforcement system is encapsulated with concrete or a cement material;

a final tunnel reinforcement system; wherein the final tunnel reinforcement system is encapsulated with concrete or a cement material; and a moisture barrier system; wherein the moisture barrier system is positioned between the initial tunnel reinforcement system encapsulated with concrete or a cement material, and the final tunnel reinforcement system encapsulated with concrete or a cement material;

wherein the initial tunnel reinforcement system and the final tunnel reinforcement system comprise:

a plurality of structural supports positioned at spaced intervals along the length of a tunnel;

wherein each structural support comprises a plurality of structural segments connected in an end to end relationship;

wherein each structural segment comprises a plurality of bars connected to a first end and a second end; wherein the first end comprises a first butt plate having one or more apertures, and the second end comprises a second butt plate having one or more apertures;

wherein the one or more apertures of the first butt plate or the second butt plate of a structural segment are coaxially aligned with the one or more apertures of the first butt plate or the second butt plate of another structural segment in an end to end relationship;

wherein the first butt plate or the second butt plate of a structural segment is attachable to the first butt plate or the second butt plate of another structural segment in an end to end relationship; and wherein each structural support defines a geometric supporting framework.

19. The method of claim 18 wherein the substrate comprises rock, soil, or an existing structure.

20. The method of claim 18 wherein the moisture barrier system comprises a plastic material, sealant, or foam.

21. The method of claim 18 wherein the structural supports comprise lattice girders.

22. The method of claim 18 wherein the initial tunnel reinforcement system has fewer structural supports positioned at spaced intervals along the length of a tunnel, than the final tunnel reinforcement system.

23. The method of claim 18 wherein the geometric supporting framework comprises an ellipsoid or trapezoid.

24. The method of claim 18 wherein the structural segments comprise from about three (3) to about twelve (12) bars connected to the first end and the second end.

25. The method of claim 18 wherein the structural segments comprise three (3) bar spider structural segments, four (4) bar spider structural segments, eight (8) bar spider structural segments, or mixtures thereof.

26. The method of claim 18 wherein the first butt plate or the second butt plate of a structural segment is hingedly attachable to the first butt plate or the second butt plate of another structural segment in an end to end relationship.

27. The method of claim 26 wherein one or more hinges pivotally connect the structural segments in an end to end relationship.

28. The method of claim 18 wherein the one or more apertures of the first butt plate or the second butt plate of a structural segment are attachable with the one or more apertures of the first butt plate or the second butt plate of another structural segment in an end to end relationship with one or more bolts and nuts.

29. The method of claim 18 wherein the initial tunnel reinforcement system and the final tunnel reinforcement system further comprise rebar interconnecting with the plurality of structural supports.

30. The method of claim 18 wherein the final tunnel reinforcement system further comprises mesh interconnecting with the plurality of structural supports.

31. The method of claim 18 wherein the initial tunnel reinforcement system and the final tunnel reinforcement system further comprise one or more stabilizing members connected to individual structural supports, or one or more stabilizing members connected to adjacent structural supports.

32. The method of claim 31 wherein the stabilizing members connected to individual structural supports comprise hooks, and the stabilizing members connected to adjacent structural supports comprise tie rods.

33. The method of claim 18 wherein the tunnel support system is installed in an underground tunnel for transportation or utilities.

34. The method of claim 18 wherein at least one of the initial tunnel reinforcement system and the final tunnel reinforcement system is prefabricated and installed on site.

35. The method of claim 18 wherein the tunnel support system comprises an intersection of two or more tunnel reinforcement systems.

* * * * *